United States Patent [19]

Paskert

[11] 3,932,918

[45] Jan. 20, 1976

[54] RELEASABLY ATTACHABLE CLIP

[75] Inventor: Joseph H. Paskert, Lakewood, Ohio

[73] Assignee: Eaton Corporation, Ohio

[22] Filed: Aug. 15, 1974

[21] Appl. No.: 497,589

Related U.S. Application Data

[62] Division of Ser. No. 365,943, June 1, 1973.

[52] U.S. Cl. ..... 24/260; 24/243 GC

[51] Int. Cl.[2] ..... A44B 21/00

[58] Field of Search. 24/230 AL, 251, 260, 230 CF, 24/230 F, 243 SP, 243 GC, 137 R, 230 R

[56] References Cited

UNITED STATES PATENTS

| | | | |
|---|---|---|---|
| 292,402 | 1/1884 | Barry | 24/251 |
| 1,338,050 | 4/1920 | Tucker | 24/251 UX |
| 1,515,860 | 11/1924 | Howard | 24/260 UX |
| 2,508,785 | 5/1950 | Gorny | 24/137 R |
| 2,845,672 | 8/1958 | Molene | 24/230 CF X |
| 3,137,027 | 6/1964 | Birkle | 24/260 UX |
| 3,462,803 | 8/1969 | Horton | 24/243 GC X |
| 3,847,398 | 11/1974 | Kidd | 24/230 R |

FOREIGN PATENTS OR APPLICATIONS

| | | | |
|---|---|---|---|
| 801,456 | 5/1936 | France | 24/230 AL |

*Primary Examiner*—Donald A. Griffin
*Attorney, Agent, or Firm*—Teagno & Toddy

[57] ABSTRACT

A releasably attachable clip for selective attachment to an article. The clip, which may carry an alarm actuating member or the like, is easily attached to the article and is designed to be released therefrom only upon insertion of a specially configured multi-pronged tool into specially configured mating passageways provided in the body of the clip. The specially configured tool includes a multiplicity of prongs each of which must simultaneously mechanically engage one of the multiplicity of release means within the clip at the ends of the specially configured passages to achieve non-destructive disengagement of the clip from the article.

2 Claims, 2 Drawing Figures

RELEASABLY ATTACHABLE CLIP

This is a division of application Ser. No. 365,943, filed June 1, 1973.

BACKGROUND OF THE INVENTION

1. Field of the Invention

This invention relates to releasably attachable clips and more particularly relates to releasably attachable clips which may carry alarm or monitor activating members or the like.

2. Description of the Prior Art

The use of alarms and alarm-activating members attached to articles to signal the unauthorized removal of said articles beyond a monitored point is known in the art. Several of these anti-pilferage or anti-shoplifting systems are described in some detail in U.S. Pat. Nos. 3,665,448; 3,631,442; 3,577,136 and others. In general, the systems comprise an activating device such as a magnet, a miniature circuit, a radio transmitter, or the like which may be releasably attached to an article and a monitoring device which will sound an alarm and/or take a photograph if the activating device is sensed at the monitoring point. The monitoring point is usually located at or beyond the exit of a store, or other designated area. In theory, the activating devices should be easily attached to the articles, easily removed by authorized personnel having the proper equipment and very difficult to remove without the proper equipment, especially for the amateur shoplifter who is responsible for the major portion of shoplifting losses. The activating devices should also be reusable and nondestructive to the articles to which they are attached. The specially provided tool should be difficult to simulate with commonly available articles such as pocketknives, screwdrivers or the like and the tool should be able to assume various configurations to allow for independent systems to be provided while utilizing several basic components of the releasably attaching clip. The tool should also be large enough to attract attention in the event of unauthorized use and should be permanently mountable at an authorized use point, such as a cash register or the like.

Several devices have been utilized in the prior art to attach such activating devices to articles to be protected. Heat-releasable devices of both the melted member type and the bi-metallic lever type have been utilized. These heat-releasable devices have not been totally satisfactory as they have not always been reusable, they are relatively expensive to manufacture, they are somewhat difficult and time consuming to remove and they require a heat-generating tool which may injure the article, the activating member and/or the user.

Devices utilizing special keys have also been used. These devices have proven relatively expensive, the keys have proven relatively easy to be misplaced, and the devices have been subject to shoplifters who are somewhat more accustomed to violating key devices. These key-operated devices have also proved relatively expensive for use in independent systems having different keys as the key-release means have been relatively expensive to produce.

Devices utilizing sensors such as described in U.S. Pat. No. 3,665,448, which signal when the actuating device is removed have also been used. These devices are not totally satisfactory as they require complicated monitoring apparatus, the system must be completely or partially de-activated during authorized removal after payment and removal within the confines of the store will activate the alarm while not necessarily signaling an illegal event which may tend to cause confusion, legal liability and/or non-use of the system.

SUMMARY OF THE INVENTION

In accordance with the present invention the drawbacks of the prior art have been overcome to the extent that an inexpensively produced, reusable, releasably attachable clip has been provided. The above is accomplished by utilizing a plurality of release members within the clip which will allow for release of the attached article only upon simultaneous mechanical contact of all release members. Each release member is located at the end of a specially configured passageway within the body of the clip and may easily be mechanically contacted only by use of the specially configured multi-prong tool. To provide for independent systems while utilizing the basic body of the clip and tool, the general configuration of the prongs and matching passageways may be varied, i.e., the number, shape, spacings and/or length of the passageways and mating prongs may be varied from system to system. In a clip having four or five pieces, if all passages are located within one or two of the pieces, all of the remaining pieces may be commonly used for all the independent systems. The provision of variously configured passages will tend to prohibit the production of a master tool or the use of common household tools.

Structurally the clip may have several embodiments to be described below, but generally the clip will include a body for holding the alarm activating device or similar object and a releasable article gripping portion which will release only upon simultaneous mechanical contact of all the release members which are located within the body at the ends of the various passages.

Accordingly, it is an object of the present invention to provide a new and improved releasably attachable clip.

A further object of the present invention is to provide a new and improved releasably attachable clip carrying an alarm activating member or the like which is reusable and is designed for non-destructive release from the attached article only upon insertion of a specially shaped, difficult to simulate, multi-pronged tool.

A further object is to provide a new and improved reusable, releasably attached clip which will release only upon mechanical contact to all of at least two release members which are located within the body of the clip at the ends of passages therein, the passages being of variable shapes, spacings, location and number to hinder opening other than by insertion of a specialized tool.

These and other objects and advantages of the present invention may be more fully appreciated by a reading of the following description of the preferred embodiment taken in connection with the attached drawings.

BRIEF DESCRIPTION OF THE DRAWINGS

One embodiment of the releasably attachable clip of the present invention may be seen by reference to FIGS. 1 and 2. In FIG. 1, the releasably attachable clip 210 of the alternate embodiment is shown as releasably attached to an article A, in this case a non-destructably pierceable item such as a cloth garment. Although a pin structure is illustrated for attachment of the clip to a pierceable item it is understood that other types of attachment devices such as frictional contact come within the scope of this invention.

Figure 1:
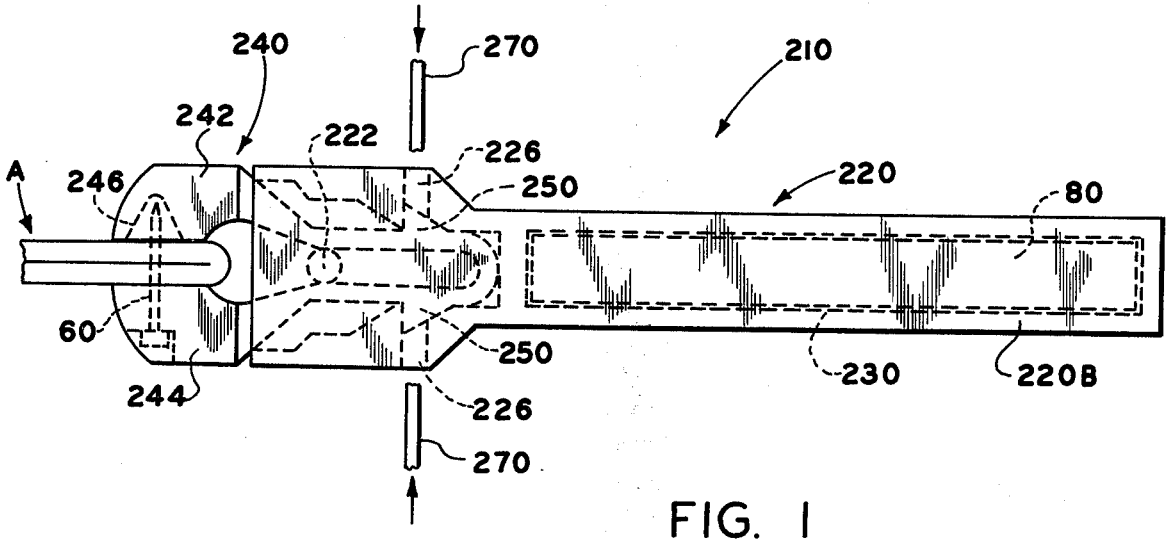
FIG. 1 is a front view in elevation of the clip of the present invention showing a releasably attachable clip releasably attached to an article to be protected and the specially configured release tool used therewith.
Figure 2:
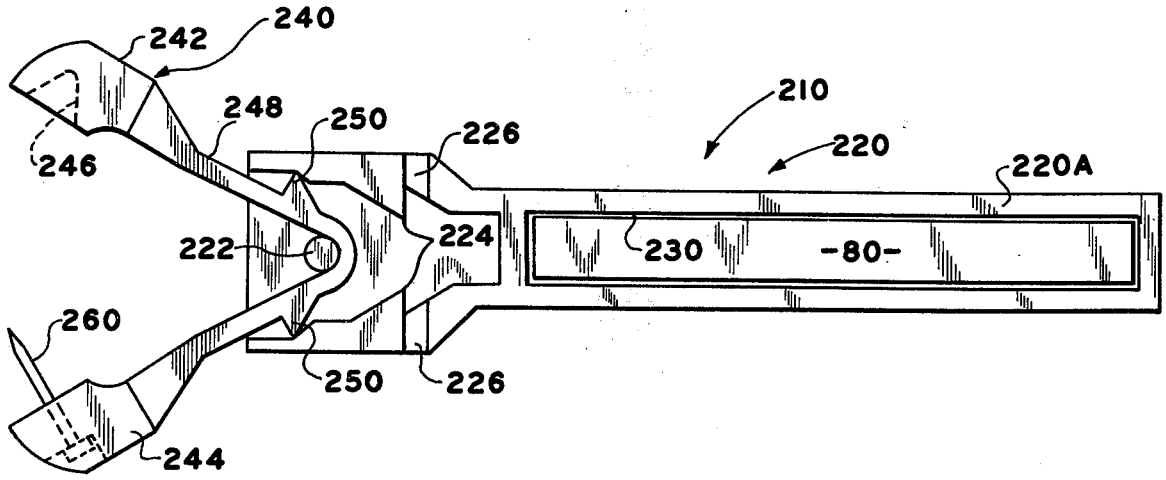
FIG. 2 is a front view of several of the components of the clip shown in FIG. 1.

The clip 210 comprises a body portion 220 formed of two complementary sections 220*a* and 220*b* and an openable and closeable normally V-shaped attachment portion 240. The attachment portion 240 includes two jaw-like sections 242 and 244, one of which mounts a projecting pin member 260 and the other of which includes a cavity 246 for receiving the exposed end of the pin member. The jaw-like sections 242 and 244, are joined by a loop-like hinge 248 which is retained in the body 220 by means of a post 222. The loop-like hinge 248 is of a resilient material and is normally in a spread-apart condition as is shown in FIG. 2. The hinge 248 has a multiplicity of releasable locking members 250 which, as is shown by phantom lines in FIG. 1, will engage stops 224 in body 220 to releasably lock the jaws in the attaching position as is shown in FIG. 1. The body, which is comprised of two complementary sections 220*a* and 220*b*, defines a multiplicity of passageways 226 which lead from the outside of the body to the releasable spring locking members 250 when the attachment portion is in the releasably attached position. Of course, the number, shape, orientation and length of the passageways and the corresponding releasable locking members may be varied to provide a series of independent systems utilizing devices similar to releasably attached clip 210.

FIG. 2 shows the clip with one of the two complementary body sections 220*a* and 220*b* removed and the clip in released position.

In FIG. 1 a cut-away portion of the disassembly tool 270 is shown as it would be inserted into passages 226 to simultaneously, mechanically contact releasable locking members 250 to release said locking members from the stops 224 allowing the releasably attached clip 210 to release article A. In the embodiment of FIG. 1, the body of 220 has an alarm activating device receiving cavity 230 therein which may receive any type of device 280. The device 80 shown in FIG. 2 is a radio transmitter designed to activate an alarm including a radio receiver.

Although this invention has been described in its preferred form with a certain degree of particularity, it is understood that the present disclosure of the preferred forms has been made only by way of example and that numerous changes in the details of construction and combination and arrangement of the parts may be resorted to without departing from the spirit and the scope of the invention and hereinafter claimed.

I now claim:

1. A clip for releasable attachment to an article to be monitored, said clip comprising:

a body for encapsulating receipt of a monitor activating device; and a normally V-shaped attachment member mounted in said body, said attachment member having a first position in which the free ends of the legs of said V-shaped member are separated for release of said article and a second position wherein the free ends of the legs of the V-shaped member are urged towards one another for releasable attachment to said article, said V-shaped attachment member including a pin extending from the free end of one of the legs and a pin receiving cavity in the free end of the other leg, said pin receiving cavity receiving said pin when said V-shaped member is in said second position;

said body defining a cavity opening to the exterior of said body in which said V-shaped attachment member is mounted, said V-shaped attachment member in said first position retained in said body by means of a shaft engaging the base of said V-shaped member, the walls of said cavity defining generally inwardly tapering surfaces which will cammingly engage the normally resiliently separated legs of the V-shaped attachment member to urge said legs together as said V-shaped attachment member is urged into said cavity to assume its said second position, said V-shaped attachment member and said body defining a plurality of mating resilient locking members and resilient locking member catches which will releasably engage when said V-shaped attachment member is in said second position to lock said V-shaped attachment member in said second position, said V-shaped attachment member releasable from said second position only upon simultaneous mechanical contact on all of said locking members, said locking members located interiorly of said body and accessible from the exterior of said clip only via a series of passageways, one for each locking member, formed in the body of said clip, at least two of said passageways opening to opposite exterior surfaces of said body.

2. The clip of claim 1 wherein said resilient locking member catches and said resilient locking members comprise a pair of shoulders defined by the side walls of said cavity and a pair of projections extending from the legs of said V-shaped member respectively.

* * * * *